US006913144B1

(12) United States Patent
Todd

(10) Patent No.: US 6,913,144 B1
(45) Date of Patent: Jul. 5, 2005

(54) YARN ORGANIZER

(76) Inventor: James L. Todd, 2618 Strait La., Houston, TX (US) 77084

( * ) Notice: Subject to any disclaimer, the term of this patent is extended or adjusted under 35 U.S.C. 154(b) by 319 days.

(21) Appl. No.: 10/215,818

(22) Filed: Aug. 9, 2002

(51) Int. Cl.[7] ..... B65D 85/00
(52) U.S. Cl. ..... 206/388; 206/49
(58) Field of Search ..... 206/388, 49, 459.5, 206/486, 733, 735, 731; 40/492

(56) References Cited

U.S. PATENT DOCUMENTS

| | | | | | |
|---|---|---|---|---|---|
| 597,165 | A | * | 1/1898 | Hall | 206/388 |
| 1,482,285 | A | * | 1/1924 | Chandler | 206/388 |
| 1,527,712 | A | * | 2/1925 | Steinthal | 206/388 |
| 3,949,452 | A | * | 4/1976 | Henderson | 206/388 |
| 4,070,775 | A | * | 1/1978 | Brooks | 40/492 |
| 4,104,809 | A | * | 8/1978 | Day et al. | 40/492 |
| 4,253,259 | A | * | 3/1981 | Schaffer et al. | 40/492 |
| D275,817 | S | * | 10/1984 | Keyser | D3/30.3 |
| 4,531,638 | A | | 7/1985 | Jacobozzi et al. | |
| 4,920,675 | A | * | 5/1990 | Mashimo | 40/492 |
| 5,358,280 | A | * | 10/1994 | Scales | 283/63.1 |
| 5,396,991 | A | | 3/1995 | Lachambre | |
| 6,112,665 | A | * | 9/2000 | Teter et al. | 101/483 |
| 6,474,693 | B1 | * | 11/2002 | Nitsche | 281/21.1 |
| 6,665,965 | B1 | * | 12/2003 | Turchi et al. | 40/492 |

* cited by examiner

*Primary Examiner*—Shian T. Luong
(74) *Attorney, Agent, or Firm*—Goldstein Law Offices PC.

(57) ABSTRACT

A yarn organizer, for conveniently holding and displaying a great variety of yarns, having at least two arms and a pivoting axle. The arms are substantially flat and have a connected end, a free end, and a plurality of openings extending fully through the arms. The openings are longitudinally spaced between the connected end and the free end. The pivoting axle extends transversely through the connected ends of the arms and allows the arms to pivot with respect to each other to selectively allow the arms to either fully or partially overlap each other. Spacers, which are located on the pivoting axle between the arms, allow for sufficient clearance for the yarn to extend through the openings of each arm and wrap around the side of the arm having that opening. Each opening of each yarn is uniquely identified with indicia.

2 Claims, 3 Drawing Sheets

YARN ORGANIZER

BACKGROUND OF THE INVENTION

1. Field of the Invention

The present invention relates to a yarn organizer which provides a convenient and inexpensive system for storing a huge variety of yarns and flosses and allows a user to view all of the different yarns in the collection simultaneously or to view only the yarns which are held by a particular arm, if this is desired.

2. Description of Related Art

In the course of textile making, one often can choose from a variety of different colored yarns. However, having many such yarns conveniently available for viewing and choosing suitable yarns is not always easy. Accordingly, there is a need for a system of organizing yarns, such that they are conveniently available, while remaining tangle-free.

Several references uncovered in the search show various storage devices. U.S. Pat. No. 5,396,991 to Lachambre appears to show a yarn holding tray comprised of a plurality of pegs, for storing numerous spools. However, since this device is apparently for holding an entire spool, it occupies considerable space, and leaves room for only a few different yarns. Accordingly, this device does not allow for the storage of a variety of yarns on a single, compact unit.

U.S. Pat. No. 6,032,798 to Bryant appears to show a storage container for yarn comprised of an array of elongated trays, each for holding a different yarn, and having an aperture at one end to dispense the yarn. Unfortunately, Bryant is large and cumbersome, and lacks the portability necessary for use in many hobby-related textile making activities.

While these units may be suitable for the particular purpose employed, or for general use, they would not be as suitable for the purposes of the present invention as disclosed hereafter.

SUMMARY OF THE INVENTION

It is an object of the invention to produce an easy-to-use and compact device which may be used to store a variety of yarns and flosses which are to be used for needlepoint, crewel and cross-stitch. Accordingly, this device is simply constructed of a number of parallel arms, each which have a number of openings which may each hold a distinct yarn.

It is a further object of the invention that the organizing device can be easily folded and stored. Accordingly, the arms are pivotally attached at one end by a transversely extending pivoting axle. The pivoting axle allows the arms to be "fanned out" to display the yarns on the various arms.

It is a further object of this invention to provide a device which is inexpensive and easy to manufacture. Accordingly, this device is constructed from readily available materials such as brass, stainless steel or lexan. Furthermore, the component arms, spacers, and cap nuts are all inexpensive and can be easily manufactured to the desired specifications, and easily assembled.

It is a further object of this invention to provide a device that allows the user to view the entire collection of yarns and flosses quickly and easily, without having to search through a variety of different containers. Accordingly, this device allows for the ready display of a great number of different types of yarns and flosses simultaneously, yet allows them all to be stored compactly by folding the arms so that they overlap each other.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
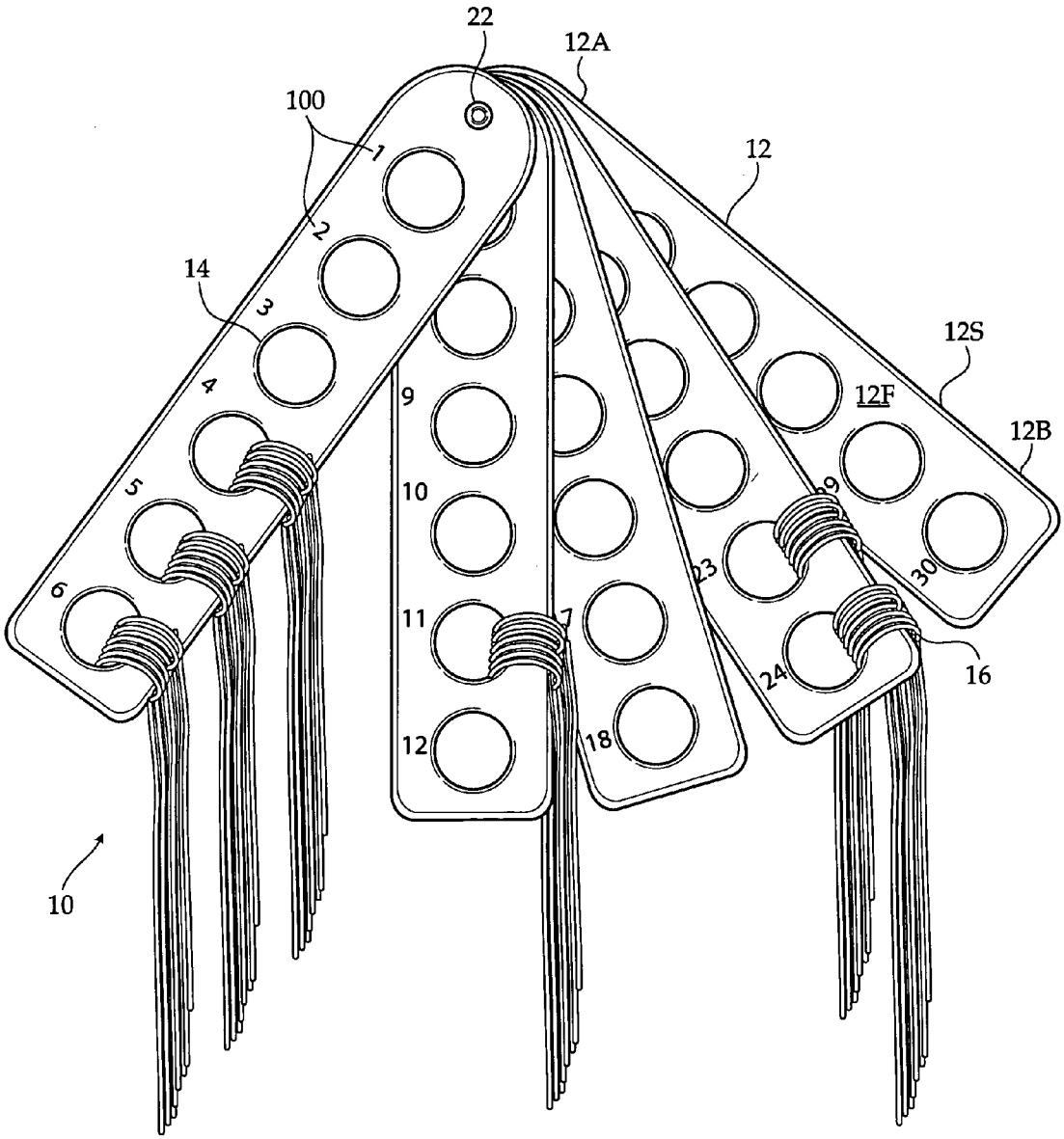
FIG. 1 is a front view of the invention, where the individual arms have been spread apart in order to facilitate easy viewing of all the yarns on the various arms.
Figure 3:
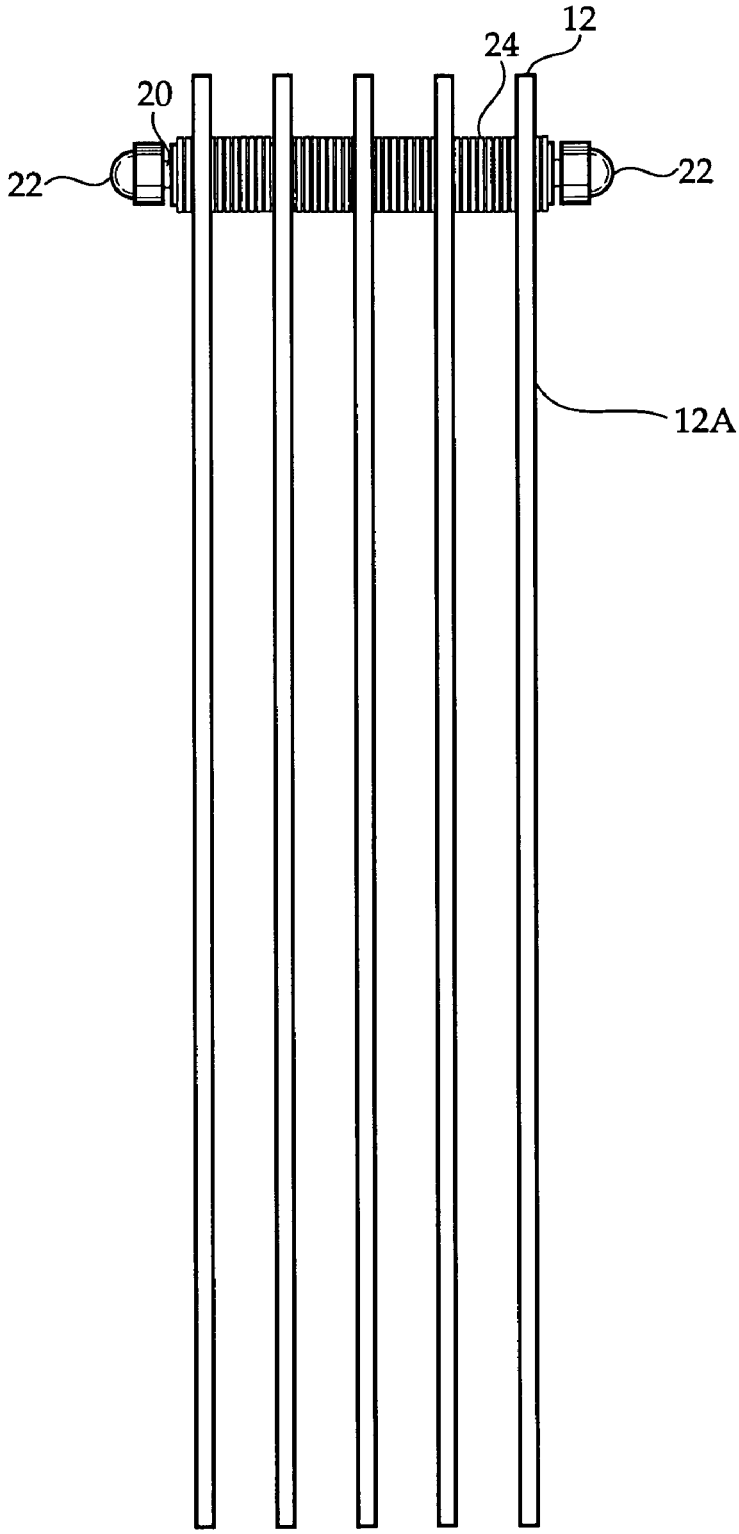
FIG. 3 is a side view of the invention per se, illustrating the spacing of the arms, and wherein the yarns have been removed for clarity.

FIG. 1 illustrates a yarn organizer 10, having a plurality of arms 12 each having a connected end 12A and a free end 12B. The arms 12 are substantially flat having a broad front surface 12F, a pair of sides 12S, and extend parallel to each other. The arms 12 are pivotally attached at the connected end 12A with a pivoting axle 20 (as seen in FIG. 3), which is covered and terminated at opposite ends of said pivoting axle 20 by a cap nut 22. As illustrated in FIG. 1, the arms 12 have been fanned with respect to each other about the cap nut 22 which covers the pivoting axle.

Each arm 12 has a plurality of openings 14 which extend fully through that arm 12. Said openings are longitudinally spaced along the arm 12 between the connected end 12A and the free end 12B. Said openings 14 are generally circular in shape and extend a substantial distance between the sides 12S of its associated arm 12. Indicia 100 are used to distinctly identify each of the openings 14, such that even among the various arms 12 each opening has a unique identity. Preferably the indicia 100 are numerals. In particular, in the example illustrated, wherein five arms 12 are provided, each having six openings 14, the openings 14 are designated with the numerals "1" through "30".

As seen in FIG. 1, a variety of different yarns 16 have been threaded through some of the openings 14 and may be easily viewed. In particular, each yarn 16 is extended through one of the openings 14 and is wrapped around one of the sides 12S of its associated arm 12. As shown, the arms do not fully overlap each other to allow the yarns 16 to be easily visualized.

Figure 2:
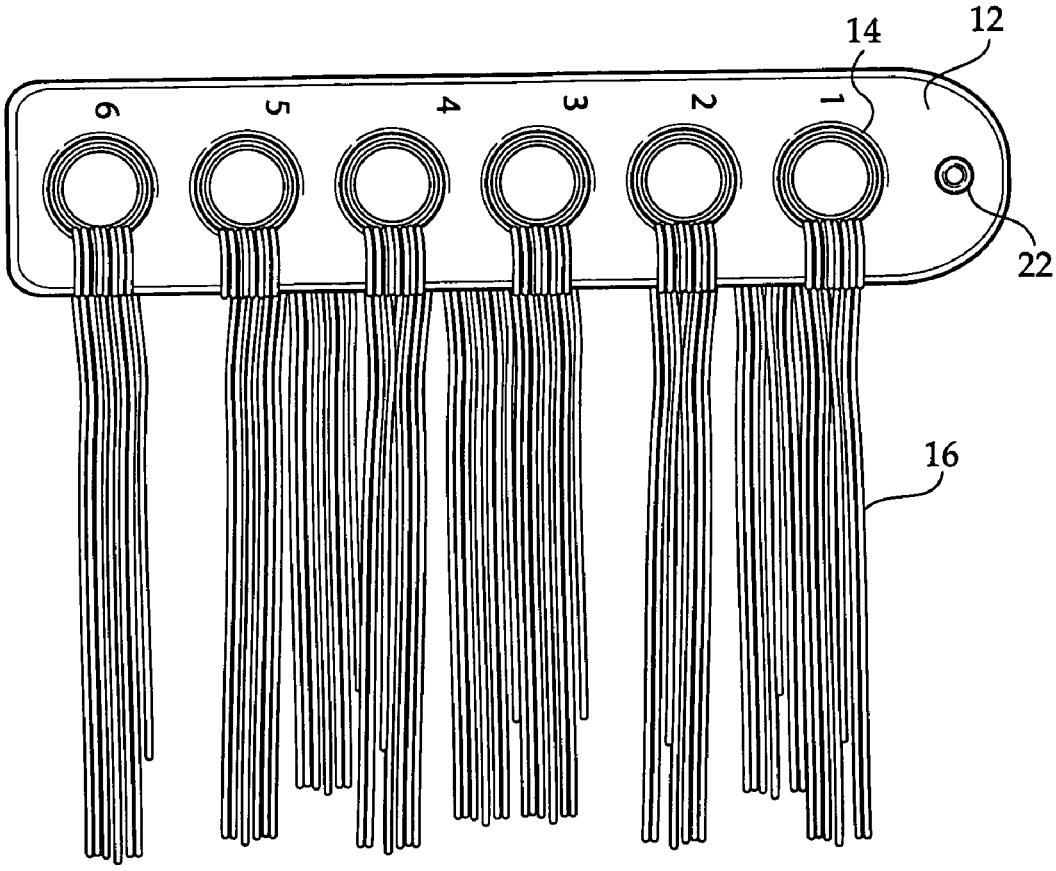
FIG. 2 is a front view of the invention, wherein the arms are overlapping so that several additional arms are concealed behind the one which is visible.

FIG. 2 illustrates the arms 12, positioned as they are when the device is being stored. Only one of the arms 12 is visible, as all of the arms 12 fully overlap each other. The openings 14 are each seen to contain a different type of yarn 16. Furthermore, the yarn being held by other underlying arms can also be seen.

FIG. 3 illustrates a side view of the device, indicating the relationship between the arms 12. In particular, as previously noted, the pivoting axle 20 extends transversely through the connecting ends 12A of all of the arms 12. However, to provide adequate space for the yarns 16 to be wrapped through the openings 14 and around the sides 12S of the arms 12, the arms 12 are separated from each other on the pivoting axle 20 with spacers 24. The spacers 24 effectively separate the arms 12 to provide sufficient clearance therebetween to meet the purposes of the present invention in storing yarn, yet ensure that the arms 12 remain parallel to each other. The spacers 24 further allow the arms 12 to rotate about the pivoting axle 20 while remaining parallel to each other. Also as previously noted, but best seen in FIG. 3, the pivoting axle 20 is covered on opposite ends thereof by the cap nuts 22. The cap nuts 22 also are configured to keep the arms 12 and spacers 24 tightly together. In this regard, the ends of the pivoting axle 2Q as well as the cap nuts 22 may be threaded so as to engage each other.

In conclusion, herein is presented a yarn organizer. The invention is illustrated by example in the drawing figures, and throughout the written description. It should be understood that numerous variations are possible, while adhering to the inventive concept. Such variations are contemplated as being a part of the present invention.

What is claimed is:

1. A method of organizing a plurality of yarns, using a device having at least two arms, the arms having a connected end, a free end, and a pair of sides, a plurality of openings extend through each of the arms, the arms extend substantially parallel to each other, a pivoting axle extending transversely through the connecting ends of the arms, comprising the steps of:

attaching the yarns through the openings, by extending each yarn through one of the openings and wrapping said yarn around one of the sides of the arm having said one of the openings;

storing the yarns by pivoting the arms so that they fully overlap each other while remaining parallel to each other; and displaying the yarns by fanning the arms to reveal all of the openings on all of the arms, by pivoting the arms so that they only partially overlap each other while remaining parallel to each other.

2. The method as recited in claim 1, wherein each of the openings have indicia located adjacent thereto, further comprising the step of:

uniquely identifying each opening with the indicia.

* * * * *